US009776402B2

(12) United States Patent
White et al.

(10) Patent No.: US 9,776,402 B2
(45) Date of Patent: Oct. 3, 2017

(54) THERMAL INK JET PRINTHEAD

(71) Applicant: HEWLETT-PACKARD DEVELOPMENT COMPANY, L.P., Houston, TX (US)

(72) Inventors: Lawrence H. White, Corvallis, OR (US); Anthony M. Fuller, Corvallis, OR (US); Huyen Pham, Corvallis, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 15/111,269

(22) PCT Filed: Jan. 29, 2014

(86) PCT No.: PCT/US2014/013523
§ 371 (c)(1),
(2) Date: Jul. 13, 2016

(87) PCT Pub. No.: WO2015/116050
PCT Pub. Date: Aug. 6, 2015

(65) Prior Publication Data

US 2016/0325547 A1 Nov. 10, 2016

(51) Int. Cl.

| | |
|---|---|
| ***B41J 2/14*** | (2006.01) |
| ***B41J 2/335*** | (2006.01) |
| ***B41J 2/16*** | (2006.01) |

(52) U.S. Cl.
CPC ..... *B41J 2/14112* (2013.01); *B41J 2/1601* (2013.01); *B41J 2/1626* (2013.01); *B41J 2/3351* (2013.01); *B41J 2/3354* (2013.01); *B41J 2/3357* (2013.01); *B41J 2/33515* (2013.01); *B41J 2/3353* (2013.01)

(58) Field of Classification Search
None
See application file for complete search history.

(56) References Cited

U.S. PATENT DOCUMENTS

| | | | |
|---|---|---|---|
| 4,860,252 | A | 8/1989 | Sykora |
| 5,828,814 | A | 10/1998 | Cyman et al. |
| 7,080,193 | B2 | 7/2006 | Roohparvar |
| 8,444,255 | B2 | 5/2013 | White et al. |
| 2004/0227791 | A1 | 11/2004 | Anderson et al. |

(Continued)

FOREIGN PATENT DOCUMENTS

| | | |
|---|---|---|
| EP | 1170129 | 1/2002 |
| WO | WO-2007024656 | 3/2007 |

OTHER PUBLICATIONS

SPEAr320 Architecture and Functionality; RM0307 Reference Manual; Sep. 2011.

*Primary Examiner* — Lisa M Solomon
(74) *Attorney, Agent, or Firm* — HP Inc.—Patent Department

(57) ABSTRACT

The present disclosure includes a method of fabricating a thermal ink jet printhead including depositing a first metal layer having a thickness to form a power bus, deposing a first dielectric layer, forming a via in the first dielectric layer to connect the first metal layer to a second metal layer, depositing the second metal layer, depositing a resistive layer, forming a thermal resistor in the resistive layer, depositing a second dielectric layer, and removing a portion of the second dielectric layer.

20 Claims, 4 Drawing Sheets

(56) References Cited

U.S. PATENT DOCUMENTS

| | | | | |
|---|---|---|---|---|
| 2006/0146093 | A1 | 7/2006 | Song et al. | |
| 2009/0141087 | A1 | 6/2009 | Lee et al. | |
| 2009/0174758 | A1 | 7/2009 | Yamada et al. | |
| 2012/0293587 | A1 * | 11/2012 | Bakker | B41J 2/14129 347/63 |

* cited by examiner

THERMAL INK JET PRINTHEAD

BACKGROUND

An ink jet image can be formed using precise placement on a print medium of ink drops emitted by an ink drop generating device known as an ink jet printhead. Typically, an ink jet print head is supported on a movable print carriage that traverses over the surface of the print medium and is controlled to eject drops of ink at appropriate times pursuant to command of a microcomputer or other controller. The timing of the application of the ink drops can correspond to a pixel pattern of the image being printed.

One type of an ink jet printhead includes an array of precisely formed nozzles in an orifice plate. The orifice plate can be attached to an ink barrier layer which can be attached to a film substructure that implements ink firing heater resistors and circuitry for enabling the resistors. The ink barrier layer can define ink channels including ink chambers disposed over the associated ink firing resistors, and the nozzles in the orifice plate can be aligned with associated ink chambers.

DETAILED DESCRIPTION

Figure 1:
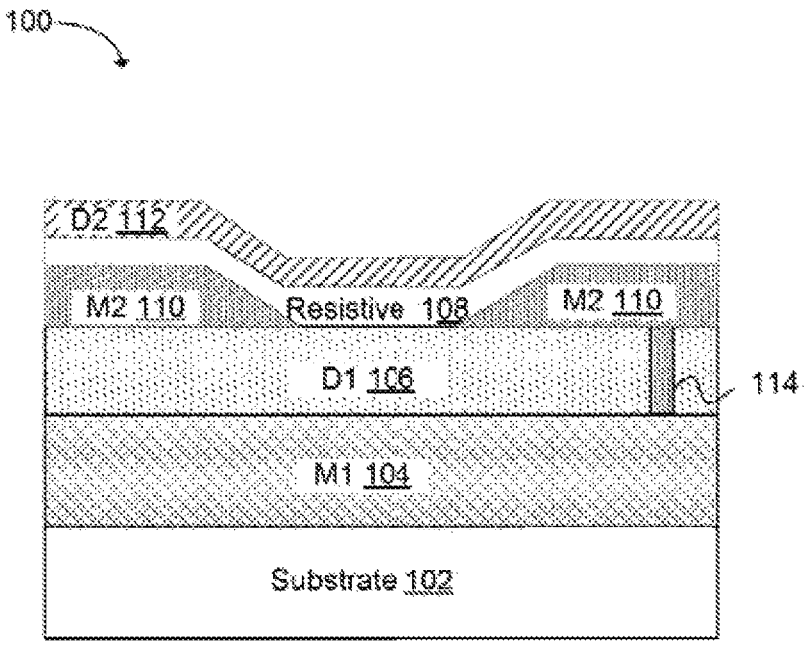
FIGS. 1-2 illustrate diagrams of examples of an ink jet printhead substrate according to the present disclosure.

An ink jet printhead can be fabricated using a complementary metal-oxide-semiconductor (CMOS) process, which can be referred to as a jet metal-oxide-semiconductor (JetMOS) process when used to create an ink jet printhead die. The integrated circuits (ICs) or dies used in the ink jet printhead can be fabricated using various layers and material to make electrical circuit components and provide specific functions for the printhead. Layers can include metal layers for capacitors and connecting circuits, dielectric or insulation layers for capacitors and transistors and electrical insulation between conducting layers, diffusion layers for forming transistors, protection or passivation layers to protect the circuit from the environment, and/or a resistive layer for heat generation.

Thermal ink jet printheads with a high nozzle density, such as 1200 nozzles per column inch, may not allow for sufficient room for return traces to be routed between adjacent resistors. In such instances, the return trace and/or ground plane is located below the resistors themselves and may be separated from the resistors by a dielectric layer. One or more vias in the dielectric layer may be used to connect the resistor trace to the return path. However, the vias am located close to the ink feed slot and may need to be protected from ink attack. Further, the via formation can lead to topography in the overlaying dielectric layers. The overlaying dielectric layers can, therefore, be prone to cracking, particularly when brittle material are used. The typical film above this region can be a thin dielectric layer and the anticavition film.

Previous thermal ink jet printhead substrate designs can include a single large opening in the dielectric layer that spans the whole region from one side of the ink feed slot to the other side. Typically, such a dielectric layer can include tetraethyl orthosilicate (TOES). The opening can be formed using a wet etch process. A wet etch process, as used herein, can include etching a layer of material using wet chemistry. Removal of the dielectric layer from above the resistors can limit the turn on energy for the resistors to a reasonable value and prevent excessive heating of the resistors. Further, the dielectric layer may be directionally removed from the ink feed slot to facilitate topside processing of the slot and to allow ink flow within the printhead. The wet etch process results in a slope of around 4 micrometers (μm) per side. In order to accommodate this slope, the distance between a thermal resistor and an ink feed slot is lengthened resulting in a corresponding reduction in the ink refill time after drop ejections (e.g., longer shelves and slower returns).

Examples in accordance with the present disclosure can include methods of fabricating and thermal ink jet printheads that provide protection to the vias from ink and process chemicals through the design of the printhead circuit or dies. The thermal ink jet printheads can include separate openings in the dielectric layer (e.g., TEOS layer) for each resistor column as opposed to a single large opening. For instance, methods in accordance with the present disclosure can include removing a first portion of the dielectric layer from above the ink feed slot using a directional etch process (e.g., a dry etch process) and removing a second portion of the dielectric layer from above a resistor using a second etch process (e.g., a wet etch process). "Above", as used herein, can refer to a layer farther from the substrate than another layer and "below" can refer to a layer closer to the substrate than another layer. Such a thermal ink jet printhead can allow for increased nozzle density, such as 1200 nozzles per column inch, as the ink feed slot can be near the thermal resistors, thus increasing accuracy, with decreased refill time as compared to previous designs. Further, the protection provided to the vias can increase reliability of the thermal ink jet printheads.

In the following detailed description of the present disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be used and the process, electrical, and/or structural changes may be made without departing from the scope of the present disclosure.

The figures herein follow a numbering convention in which the first digit or digits correspond to the drawing figure number and the remaining digits identify an element or component in the drawing. Elements shown in the various examples herein can be added, exchanged, and/or eliminated so as to provide a number of additional examples of the present disclosure.

In addition, the proportion and the relative scale of the elements provided in the figures are intended to illustrate the examples of the present disclosure, and should not be taken in a limiting sense. As used herein, "a number of" an element and/or feature can refer to one or more of such elements and/or features.

As used herein, metal layers in integrated circuit (IC) processing can be formed after diffusion and other high temperature processes, so the thermal processes do not melt the metal, diffuse the metal into other layers, or degrade the performance of the metal or traces. Thus, the metal layers or electrically conducive layers can be found in the upper layers of a printhead circuit or performed in the later processing steps. Metal or conductive layers can have a low resistance value allowing current to flow with minimal heat generation, which can be measured by sheet resistance ($R_S$). Sheet resistance can be calculated based on the thickness of the layer and the resistivity of the material. Conductive layers can have a high thermal conductivity.

Thermal resistors can be fabricated in a resistive layer formed from a resistive material. The resistive material can have a high resistivity relative to a conductor and a lower resistivity relative to an insulator. The thermal resistors can generate heat for an ink chamber when current flows through the resistor. A power bus or traces in a power plane can be used to provide current to the thermal resistors. A ground bus or traces in a ground plane can be used to take current away from the thermal resistors. A power bus can refer to a structure used to provide current to a circuit component and a ground bus can refer to a structure used to take current away from a circuit component or providing a mechanism to drain or eliminate excess electrical energy from circuits.

Ink jet printhead dies can use a metal layer to connect wire leads from the chip package to the die. For instance, the metal layer on the die can be used to provide electrical contacts or connections to the circuits on the die and to the leads on the chip packaging. Each layer formed on a substrate can be used to form circuit components and/or provide various functions in different sections of the die. Often layers can be used to provide a variety of functions and different types of circuits.

A conductive layer, often a metal layer, used to form a power bus may have a greater current capacity than other metal layers. A metal layer's current capacity can be determined by the conductive material's resistivity, the metal layer thickness, and the area of the traces used in the power bus. A power bus metal layer can be thicker than other metal layers. For example, if a standard non-power-bus metal layer has a depth or overall thickness of 0.8 μm with a metal or metal alloy, a power bus metal layer can have a depth of 12 μm with the same metal or metal alloy.

Figure 2:
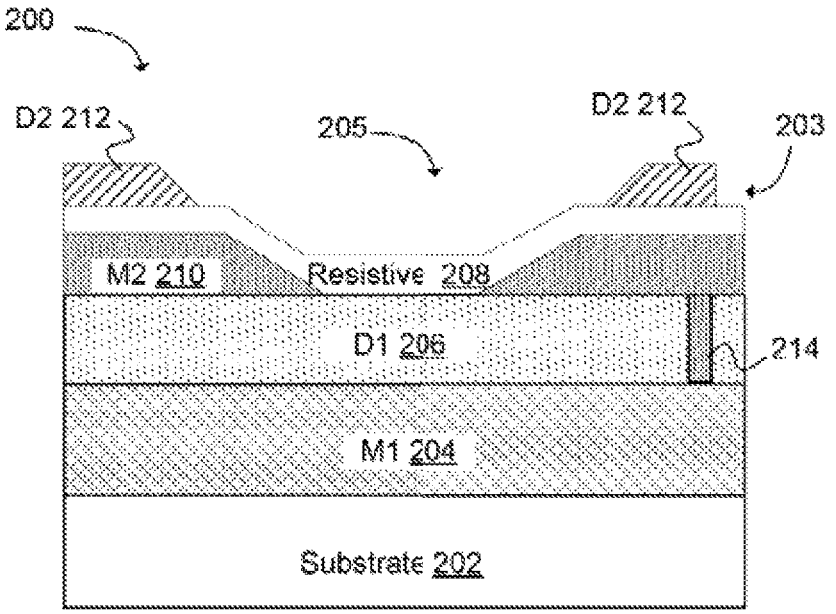

FIGS. 1-2 illustrate diagrams of examples of an ink jet printhead substrate according to the present disclosure. For instance, FIG. 1 illustrates examples of layers that can be used in a thermal inkjet printhead 100 with a first metal layer 104 between the substrate 102 and a resistive layer 108. The first metal layer 104 can have a thickness to form a power bus. The substrate 102 may include silicon (Si), gallium arsenide (GaAs), or other elements and compounds used in semiconductor wafers and dies. A thermal resistor can be formed in the resistive layer 108. A first dielectric layer 106 can provide electrical insulation and thermal insulation between the resistive layer 108 and the first metal layer 104. A second metal layer 110 can be above the first dielectric layer 106. Reference to a thickness of a layer can refer to overall thickness, average thickness, or targeted thickness, where a targeted thickness can be a process used to achieve a specified thickness of material in a layer.

Forming a thermal resistor, as used herein, can include forming circuit traces and removing portions of the deposited second metal layer 110 (e.g., etching) to create space (e.g., openings) for the one or more thermal resistors. The second metal layer 110 can be covered with a resistive layer 108 (e.g., WSiN) and the combined stack can be etched to yield circuits with thermal resistors.

The second metal layer 110 can be adjacent to or in contact with the resistive layer 108 and provide current to the thermal resistors, as illustrated in FIG. 1. The resistive layer 108 can be on top of the second metal layer 110 except where the second metal layer 110 is removed to leave space for forming a resistor in the resistive layer 108. As illustrated by FIG. 1, the removal of the second metal layer 110 to leave space for forming the resistor can, for instance, result in slopes of the second metal layer 110 at the ends of the resistor. In a number of examples, the second metal layer 110 may be used as a power and/or ground bus and a first metal layer 104 may be used as a power and/or ground bus. The first metal layer 104 and/or second metal layer 110 can be used to couple or connect the thermal resistor to a control circuit or other electronic circuits on the thermal inkjet printhead 100. The first dielectric layer 106 can be between the first metal layer 104 and second metal layer 110.

As illustrated by FIG. 1, a via 114 can be formed in the first dielectric layer 106 to connect the first metal layer 104 and the second metal layer 110. The via 114 can be protected from ink from the ink feed hole (not shown) by a second dielectric layer 112. A via, as used herein, can include an electrical connection between layers in the printhead circuit that goes through the plane of one or more adjacent layers.

The inkjet printhead 100 can include a second dielectric layer 112 above the second metal layer 110 anchor the resistive layer 106, where "below" can refer to a layer closer to the substrate than another layer and "above" can refer to a layer farther from the substrate than another layer. The second dielectric layer 112 can, for instance, provide protection to the via 114 from ink ingress due to the close proximity of the via 114 to the ink feed hole. An ink feed hole can be a hole etched through the die in order to get ink from a pen to the flow channels and chamber which can be defined in a polymer layer.

As illustrated by FIG. 2, an inkjet printhead 200 in accordance with the present disclosure can have portions of the second dielectric layer 212 removed. FIG. 2 can include an illustration of the inkjet printhead 100 illustrated in FIG. 1 with portions of the second dielectric layer 112 removed.

The inkjet printhead 200 illustrated by FIG. 2 can include a first metal layer 204 between the substrate 202 and a resistive layer 208, a first dielectric layer 206 between the resistive layer 208 and the first metal layer 204, a second metal layer 210 adjacent to the resistive layer 208, a second dielectric layer 212, and a via 214 formed in the first dielectric layer 206.

Portions of the second dielectric layer 212 can be removed. For instance, portions remove removed can include a first portion 203 of the second dielectric layer 212 directionally removed from above an ink feed slot and/or a second portion 205 of the second dielectric layer 212 removed from above a thermal resistor formed in the resistive layer 208. An ink feed slot, as used herein, can include an aperture which forms a fluidic connection between a primary ink reservoir and a plurality of firing chambers. The first portion 203 of the second dielectric layer 212 can be removed using a directional etch process and the second portion 206 of the second dielectric layer 212 can be removed using a second etch process, as discussed further herein.

Figure 4:
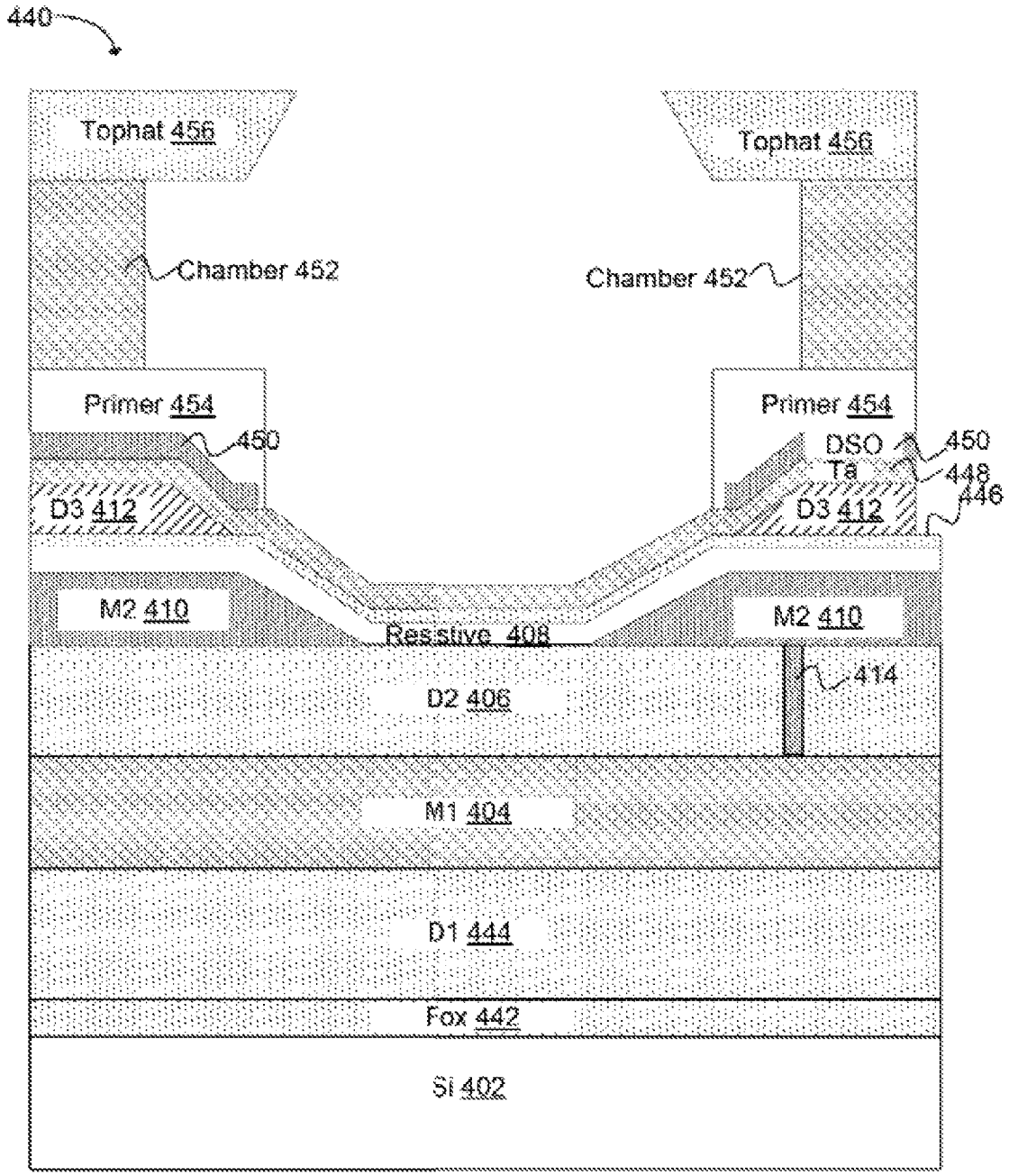
FIG. 4 illustrates a diagram of an example of a thermal ink jet printhead substrate according to the present disclosure.

Although the examples of FIGS. 1-2 illustrate a substrate layer 102, 202, a first metal layer 104, 204, a first dielectric layer 106, 206, a resistive layer 108, 298, a second metal layer 110, 210, a second dielectric layer 112, 212, and a via 114, 214, examples in accordance with the present disclosure are not so limited. An ink jet printhead substrate in accordance with the present disclosure can include a number of layers in addition to those illustrated by the examples of FIGS. 1-2. For example, as illustrated in the example of FIG. 4, an ink jet printhead substrate can include a field oxide (Fox) layer (e.g., FOX 442 of FIG. 4) deposited on the substrate layer (e.g., Si 402 of FIG. 4) and a dielectric layer (e.g., D1 444 of FIG. 4) can be deposited between the Fox layer and the first metal layer (e.g., M1 404).

Figure 3:
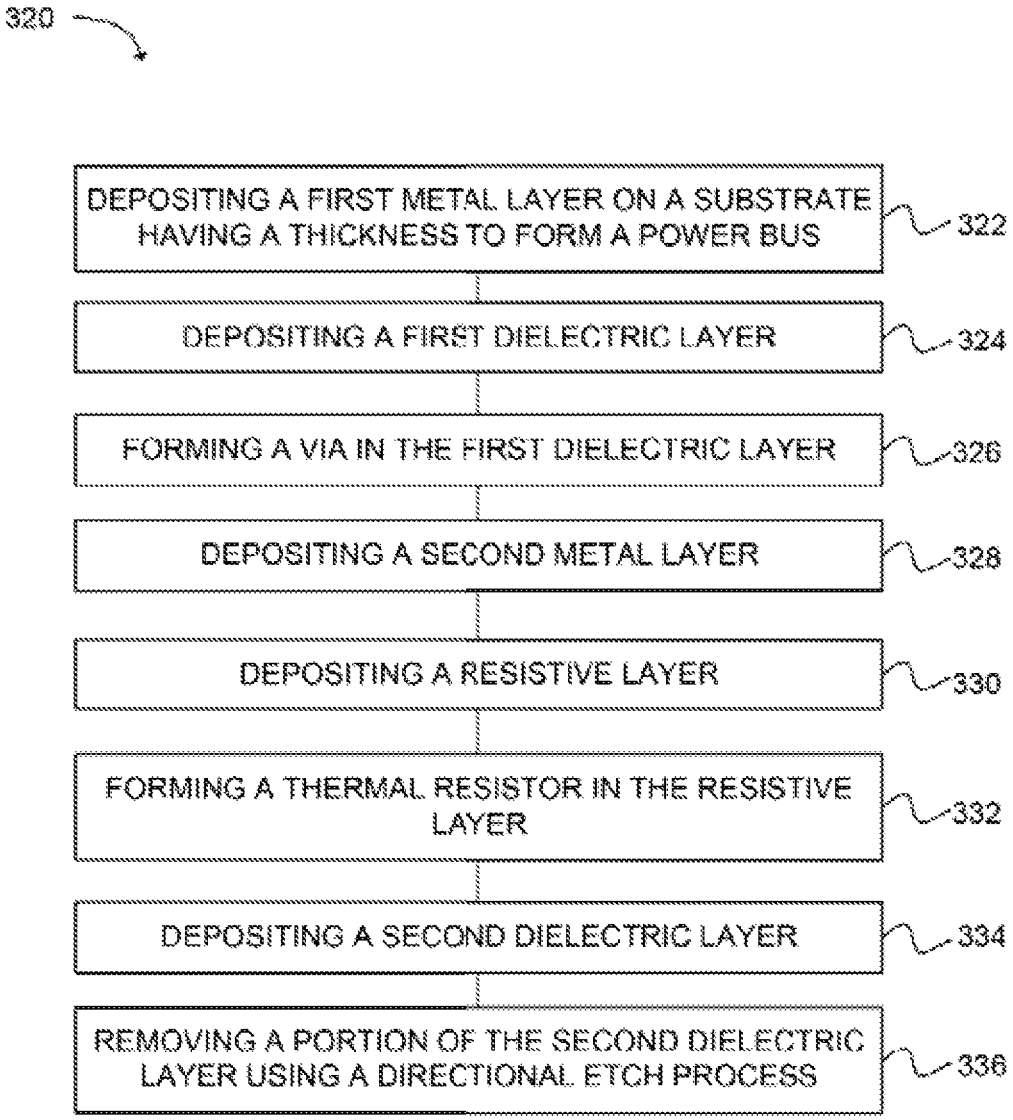
FIG. 3 illustrates a flow chart of an example of a method for fabricating a thermal ink jet printhead according to the present disclosure.

FIG. 3 illustrates a flow chart of an example of a method 320 for fabricating a thermal ink jet printhead according to the present disclosure. The method 320, at 322, can include depositing a first metal layer on a substrate having a thickness to form a power bus. In various examples, the method 320 can include growing a FOX layer (e.g., as discussed further herein).

At 324, the method 320 can include depositing a first dielectric layer. At 326, the method 320 can include learning a via in the first dielectric layer and, at 328, the method 320 can include depositing a second metal layer. The second metal layer can, for instance, be adjacent to a resistive layer (e.g., due to removal of portion of the second metal layer) to connect the thermal resistor to control circuitry. In various examples, the method 320 can include forming circuit traces and space for a thermal resistor in the second metal layer. A resistive layer can be deposited, at 330. The method 320 for fabricating a thermal ink jet printhead, at 332, can include forming a thermal resistor in the resistor layer. At 334, the method can include depositing a second dielectric layer.

In a number of examples, a first dielectric layer can be deposited on the FOX layer. In such an example, the first dielectric layer (e.g., of 324) can include a second dielectric layer and the second dielectric layer (e.g., of 334) can include a third dielectric layer.

Further, at 338, the method 320 can include removing a portion of the second dielectric layer using a directional etch process. A directional etch process, as used herein, can include a process that etches material in an intended direction (e.g., with limited and/or no slope). For instance, the directional etch process can include a dry etch process. The removed portion can be from an ink feed slot, for example.

A dry etch process, as used herein, can include the removal of material from the printhead circuit by exposing the material to ions that dislodge portions of the material from the exposed surface. The ions can typically include a plasma of reactive gases, such as fluorocarbons, oxygen, chlorine, boron trichloride, nitrogen argon, helium, among other gases. A dry etch process can, for instance, etch directionally (e.g., no resulting slope from the etch process). For instance, 1 μm of the second dielectric layer (e.g., TEOS) can be removed using the dry etch process. Removing the portion using a dry etch process can, for instance, allow for closer proximity of the thermal resistor and the ink feed slot as compared to a wet etch process. The closer proximity can reduce ink refill time after drop ejection as compared to a farther proximity of the thermal resistor to the ink feed slot.

In various examples, the portion can include a first portion and the method 320 can include removing a second portion of the second dielectric layer using a second etch process. The second etch process can include a different process than the directional etch process, for instance. For example, the second etch process can include a wet etch process, as described further herein.

FIG. 4 illustrates a diagram of an example of a thermal ink jet printhead substrate 440 according to the present disclosure. For instance, the diagram illustrates a plurality of savers of the thermal ink jet printhead 440.

As illustrated in FIG. 4, a field oxide (FOX) layer 442 can be formed on a silicon (Si) 402 substrate layer. The field oxide can be a dielectric material. A dielectric material for the field oxide, dielectric layer (e.g., first dielectric layer 444, second dielectric layer 406, and/or third dielectric layer 410), and other electrical and/or thermal insulating layers can include tetraethyl orthosilicate (TEOS or $Si(OC_2H_5)_4$), silicon dioxide ($SiO_2$), undoped silicate glass (USG) phospho-silicate glass (PSG), boro-silicate glass (BSG), and boro-phospho-silicate glass (BPSG), $Al_2O_3$, $HfO_3$, SiC, SiN, or combination of these materials.

The FOX layer 442 can be grown from the silicon 402 or created from the oxidation of the silicon 402. The conductive layer or metal layer, the resistive layer, the dielectric layer, the passivation layer, a polymer layer, and other layers may be deposited using physical vapor deposition (PVD), chemical vapor deposition (CVD), electrochemical deposition (ECD), molecular beam epitaxy (MBE) or atomic layer deposition (ALD). Photolithography and masks may be used to pattern the dopants and the other layers. Photolithography may be used to protect or expose a pattern to etching which can remove material from the conductive or metal layer, the resistive layer, the dielectric layer, the passivation layer, the polymer layer and other layers. Etching may include wet etching, dry etching, chemical-mechanical planarization (CMP), reactive-ion etching (RIE), deep reactive-ion etching (DRIE). Etching may be isotropic or anisotropic. The resulting features from deposition and etching of layers can be resistors, capacitors, sensors, ink chambers, fluid flow channels, contact pads, wires, and traces that can connect the devices and resistors together.

The silicon 402 may be doped or implanted with elements like boron (B), phosphorous (P), arsenic (As) to change the silicon's electrical properties and may be used to create regions or wells that can be used to create junctions used for diodes and transistors. The elements or dopants may be used to change the electrical properties affecting current low and direction of current flow. The elements or dopants may be deposited on the surface of the wafer by an ion implantation process. The dopants may be selectively applied to the silicon using a mask or an implant mask and may create an implanted doped layer (not shown). The mask may be applied using photolithography. The dopants may be absorbed by the wafer and diffused through the silicon using a heat, thermal, annealing, or rapid thermal annealing (RTA) process.

In some examples, a polysilicon layer may be deposited on the surface of the wafer or silicon 402. The polysilicon layer can be a conductive layer.

A first dielectric layer 444 can be deposited on the substrate. The first dielectric layer 444 can include boro-phospho-silicate glass (BPSG) and/or an undoped silicate glass (USG), among other materials. The USG layer can provide a silicate glass without dopants, such as boron and phosphate, which can leech into a silicon substrate and change the electrical characteristics of the silicon substrate. The first dielectric layer 444 can provide electrical insulation between the polysilicon layer and/or silicon 402 and the first metal layer 404.

The first metal layer 404 can be deposited on the substrate and can have a thickness to form a power or ground bus. A first metal layer 404 and/or a second metal layer 410 can include platinum (Pt), copper (Cu) with an inserted diffusion barrier, aluminum (Al), tungsten (W), titanium (Ti), molybdenum (Mo), palladium (Pd), tantalum (Ta), nickel (Ni), or combination. The metal layer may have a thermal conductivity (K) greater than 20 W/(m·K) for temperature range between 25° C. and 127° C. For example, the first metal layer 404 can include Al with a 0.5% Cu. The first metal layer 404 can be between 0.4 μm and 2.0 μm thick, and can have a sheet resistance of less than 45 mΩ/square. In some examples, the first metal layer 404 may include AlCuSi. AlCuSi can be used to prevent or help reduce junction spiking.

A second dielectric layer 406 (which is equivalent to the first dielectric layer 206 illustrated in FIG. 2) can provide electrical insulation to prevent shorting between the thermal resistor in a resistive layer 408 and the first metal layer 404. Further, a via 414 can be formed in the second dielectric layer 406 to connect the first metal layer 404 and a second metal layer 410. The second dielectric layer 408 can be a boro-phospho-silicate glass (BPSG) layer. The BPSG layer can be thicker than a USG layer. The BPSG layer and/or the USG layer can provide thermal and/or electrical insulation or isolation between first metal layer 404 and the silicon 402 substrate layer. The BPSG layer may have better thermal and/or electrical insulation properties than a USG layer.

The second dielectric layer 406 can provide thermal insulation to reduce heat dissipation from the thermal resistor to the thermally conductive first metal layer 404. The second dielectric layer 406 can reduce the effects of the first metal layer 404 acting as a heat sink. The second dielectric layer 406 can be deposited on the substrate (e.g., Si 402) and can have a thickness, thermal conductivity (K), and/or thermal diffusivity ($\alpha$) so the turn on energy of the thermal resistors is not excessive and can provide a steady state heat accumulation and dissipation. Heat accumulation cars be the heat used to eject the ink or fluid from the chamber. Heat dissipation can allow the ink or fluid into the chamber after ejection of a fluid bubble. A steady state heat accumulation and dissipation can minimize vapor lock. Thermal diffusivity (with SI unit of $m^2/s$) for a material can be a thermal conductivity divided by the volumetric heat capacity represented by $\alpha=k/\rho C_p$, where $\rho C_p$ is the volumetric heat capacity with the SI unit of $J/(m^3 \cdot K)$, $\rho$ is the density with the SI unit of $kg/m^3$, $c_p$ is the specific heat capacity with the SI unit of J/(kg·K), and K is the thermal conductivity with the SI units of W/(m·K). The thermal conductivity of the dielectric layer can be between 0.05 W/cm° K and 0.2 W/cm° K. In an example, the thermal diffusivity of the dielectric layer can be between 0.004 $cm^2$/sec and 0.25 $cm^2$/sec.

When the second dielectric layer 406 is thin, excessive energy may be applied to create a drive bubble due to heat loss to the silicon substrate 402 which can be an inefficient use of energy. When the layer is thick, heat can be trapped and eventually cause vapor lock in the ink jet chamber so the printhead does not function properly. Balanced thickness of the second dielectric layer 406 can improve ink bubble creation, heating, and delivery (or ejection). In one example, the second dielectric layer 406 may have a thickness between 0.8 μm and 2 μm to provide thermal insulation between the first metal layer and the resistive layer under the thermal resistor. In another example, the second dielectric layer 406 can have a thickness between 0.4 μm and 2 μm to provide thermal insulation between the first metal layer 404 and the resistive layer 408, generally.

A second metal layer 410 can be deposited on the substrate and can have a thickness to form a power and/or ground bus. The first metal layer 404 and/or second metal layer 410 can include Al, AlCu, AlCuSi, or combination. For example, the second metal layer 410 can include aluminum Al with copper Cu, and the second metal layer 410 can be between 1.0 μm and 2.0 μm thick. For example, the first metal layer 404 and/or second metal layer 410 can have a sheet resistance of less than 45 mΩ/square. The first metal layer 404 and/or second metal layer 410 can provide power and/or ground routing to and from bond pads formed in a bond pad layer. The second metal layer 410 can contact the thermal resistors formed in the resistive layer 408 and provide a conductive path to the thermal resistors. In a number of examples, the first metal layer 404 and/or second metal layer 410 may cover at least 50% of an area or a footprint under the bond pads of the printhead or may cover at least 50% of an area or a footprint of the printhead circuit. Selectively etching the second metal layer 410 can create a trench or trough for a thermal ink chamber.

The second metal layer 410 can, for instance, have portions removed to create space (e.g., openings) for one or more thermal resistors. The removal of the second metal layer 410 can create a slope in the second metal layer 410 that contacts each end of the thermal resistor.

In some examples, the first metal layer 404 can be removed under the thermal resistor so heat generated from the resistor in a resistive layer 408 may not dissipate or transfer to the thermally conductive first metal layer 404. Removing the first metal layer 404 under the thermal resistor formed in the resistive layer 408 and a surrounding buffer region in the thermal inkjet printhead (not shown in FIG. 4), can reduce the energy used to heat the ink and other fluids in the thermal inkjet chamber and reduce the heat transfer from the resistors in the resistive layer 408 to the first metal layer 404. Removing the first metal layer 404 under the thermal resistor can reduce unintended parasitic resistance between the resistive layer 406 and metal layer and/or shorting between the resistive layer 408 and metal layer. When the dielectric layer thickness is determined by control gate properties and/or when the dielectric layer is used for a control gate, the first metal layer 404 may not have an area or a footprint under the thermal resistors of the printhead.

A resistive layer 408 can be deposited on the substrate. The resistive layer 408 can include tungsten silicide nitride (WSiN), tantalum silicide nitride (TaSiN), tantalum aluminum (TaAl), tantalum nitride ($Ta_2N$), or combination. The resistive layer 408 can be between 0.025 μm and 0.2 μm thick, and the resistive layer 408 can have a sheet resistance between 20 Ω/square and 2000 Ω/square, for example. The thermal resistor used in a thermal ink jet printhead can be formed in the resistive layer 408.

For instance, the resistive layer 408 can be on top of the second metal layer 410 (e.g., except wherein portions of the second metal layer 410 have been removed to create space for the thermal resistors). The combined stack can be etched to yield circuits with thermal resistors. The resistor ends can, for instance, be beveled by the nature of the process.

A passivation layer 446 can be deposited on the substrate. The passivation layer 446 can include silicon carbide (SiC), silicide nitride (SiN), or a combination of such materials. In one example, the passivation layer can be between 0.1 μm and 1 μm thick. The passivation layer 446 can provide a protective coating and/or electrical insulation on the printhead, die, or wafer to protect the underlying circuits and layers from oxidation, corrosion, and other environmental conditions. For example, the passivation layer 446 can protect the substrate (e.g., Si 402), the first metal layer 404, the first dielectric layer 444, the second dielectric layer 406, and the resistive layer 408. The passivation layer 446 can improve barrier adhesion.

A third dielectric layer 412 (which is equivalent to the second dielectric layer 212 illustrated in FIG. 2) can be deposited on the substrate. The third dielectric layer 412 can include TEOS. As illustrated by FIG. 4, a first portion and a second portion of the third dielectric layer 412 can be selectively removed. The first portion can be directionally removed from above the ink feed slot and the second portion can be removed from above the thermal resistor in the resistive layer 408. The first portion removed from the ink feed slot can include 1 μm of the TEOS layer removed using a directional etch process, for instance. In various instances, portions of the Ta 448 layer and the passivation layer 446 can also be removed from above the ink feed slot.

The removal of portions of the third dielectric layer 412 using the directional etch process and the second etch process can, for instance, create one or more TEOS chambers. For example, a TEOS chamber created can enclose ink feeds by at least 4.5 μm, the first metal layer 404 and the second metal layer 410 may not overlap in the TEOS chamber regions, and/or the crossover minimum distance of the first metal layer 404 and the second metal layer 410 to the TEOS chamber can include 5.5 μm. Further, in some examples, the pillar width outside of a Inkjet feed hole can be 7 μm or more.

An adhesion layer (e.g., Ta 448) can be deposited on the substrate. Some elements and compounds, such as gold, used in fabrication may not adhere well to the substrate or other layers on the substrate. An adhesion layer can be used to adhere or join one layer to another. The adhesion layer can be used to join a bond pad layer to the passivation layer, a metal layer a resistive layer 408, a dielectric layer, or the substrate. For instance, the adhesion layer cart include tantalum (Ta) 448.

A Die Surface Optimization (DSO) 450 layer can be deposited on the substrate. The DSO 450 layer can include a second passivation and/or adhesion layer. For instance, DSO 450 can include a layer of silicon nitride (SiN) on the bottom and silicon carbide (SiC) on the top. The polymer layers 452, 454, and 456, such as an SU-8 layer that defines the ink flow channels, can adhere well to SiC. The DSO 450 can enclose any ink feed holes by at least 9 μm, for example. Said differently, a portion of the DSO 450 layer (e.g., a rectangle) that is at feast 9 μm larger than a total area of an ink feed hole (e.g., a rectangle) can be removed. Upon removing the portion of the DSO 450 layer, the DSO 450 layer can cover everything except for the area over the ink feed holes and the area over the thermal resistors.

Polymer layers 452, 454, and 456 can be deposited on the substrate. The polymer layers can include a polymer primer layer 454, a polymer chamber layer 452, and a polymer tophat layer 456. A thermal inkjet chamber can be formed in a polymer layer or plurality of polymer layers used in a thermal ink jet printhead. The chamber material for the polymer layers can include photoresist, SU-8 molecules, polymer, epoxy, or combination. The polymer layers can be formed to create fluid flow channels and/or a trough in the thermal inkjet chamber with a thermal resistor.

Figure 5:
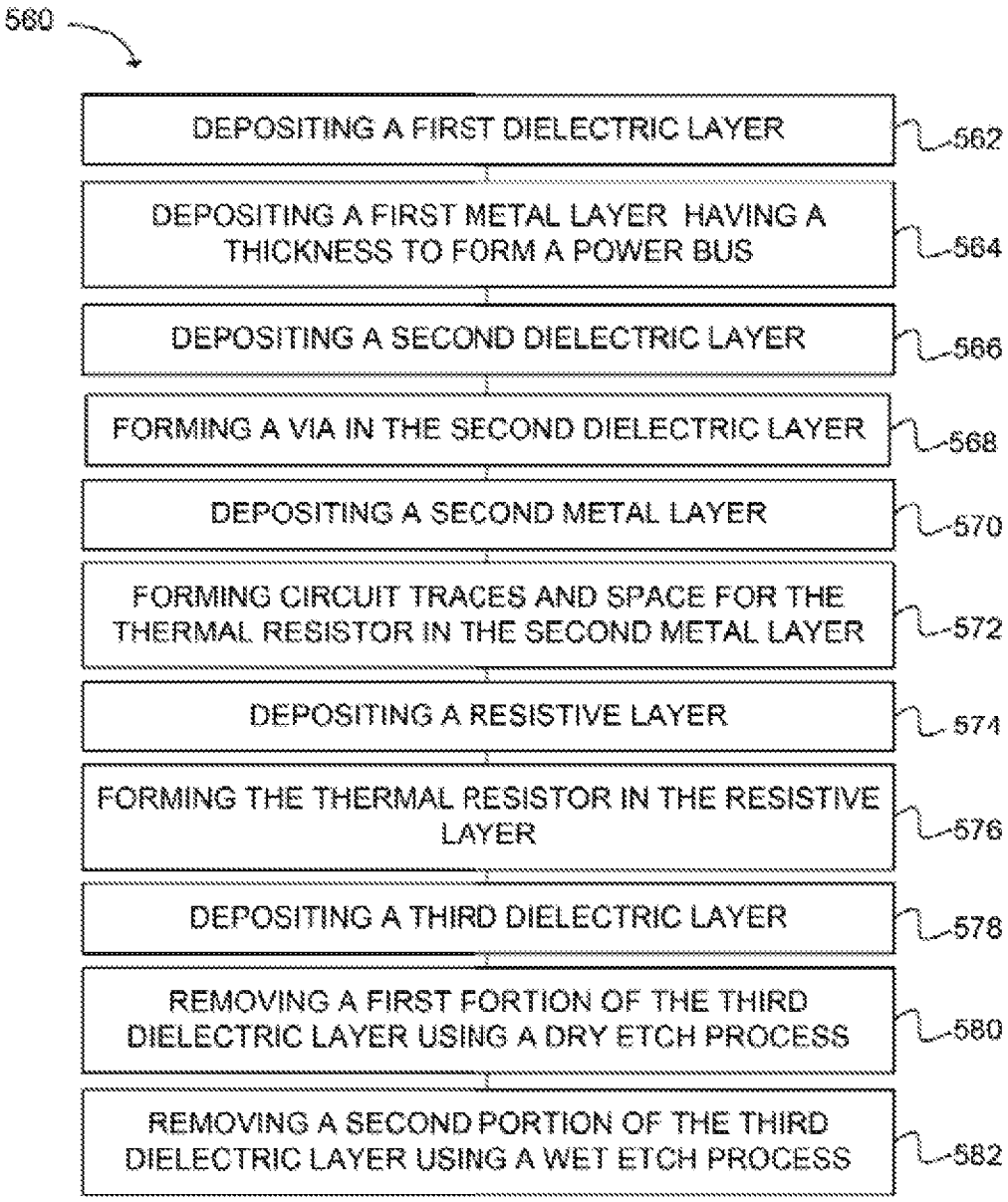
FIG. 5 illustrates a flow chart of an example of a method for fabricating a thermal ink jet printhead according to the present disclosure.

FIG. 5 illustrates a flow chart of an example of a method 560 for fabricating a thermal ink jet printhead according to the present disclosure. The method 560 can include, at 562, depositing a first dielectric layer on a substrate. At 564, the method 580 can include depositing a first metal layer having a thickness to form a power bus. At 566, the method 560 can include depositing a second dielectric layer. At 568, the method 560 can include forming a via in the second dielectric layer and, at 570, the method 560 can include depositing a second metal layer.

At 572, the method 560 can include forming circuit traces and space for a thermal resistor in the second metal layer. The space can be created, for instance, by removing portions of the second metal layer. At 574, the method 580 can include depositing a resistive layer. A thermal resistor can be formed in the reactive layer, at 576. At 578, a third dielectric layer can be deposited.

The method at 560, at 580, can include removing a first portion of the third dielectric layer using a dry etch process. At 582, the method 460 can include removing a second portion of the third dielectric layer using a wet etch process. A wet etch process can include removing material using a liquid-phase chemicals. Liquid-phase chemicals in a wet etch process can use isotopic leading to large bias when etching films. Example chemicals for a wet etch process can include buffered hydrofluoric acid (BHF), potassium hydroxide (KOH), an aqueous solution of ethylene diamine and pyrocatechol, and tetramethylammonium hydroxide (TMAH), among other chemicals.

The first portion removed can, for instance, be directionally removed from (above) an ink feed slot and/or the second portion removed can be removed from (above) the thermal resistor in the resistive layer. By removing the first portion above the ink feed slot using a dry etch process, a slope from the etch process (such as by a wet etch process) can be avoided due to the directional etching ability of the dry etch process. The directional etch using the dry etch process can allow for closer proximity of the thermal resistor to the ink feed slot as compared to a wet etch process. The closer proximity can reduce ink refill time after drop election as compared to a farther proximity of the thermal resistor to the ink feed slot.

The method for fabricating a thermal ink jet printhead may further include depositing a polymer layer, forming a thermal inkjet chamber within the polymer layer, and/or forming control circuits with the substrate, first metal layer, second metal layer, dielectric layer, and other processing layers.

As used in this document, a "printhead", "printhead circuit", and a "printhead die" mean that part of an inkjet printer or other inkjet type dispenser that dispenses fluid from one or more openings. A printhead includes one or more printhead dies. "Printhead" and "printhead die" are not limited to printing with ink and other printing fluids but also include inkjet type dispensing of other fluids and/or for uses other than printing.

The specification examples provide a description of the applications and use of the system and method of the present disclosure. Since many examples can be made without departing from the spirit and scope of the system and method of the present disclosure, this specification sets forth some of the many possible example configurations and implementations. With regard to the figures, the same part numbers designate the same of similar parts throughout the figures. The figures are not necessarily to scale. The relative size of some parts is exaggerated to more clearly illustrate the example shown.

What is claimed is:

1. A method for fabricating a thermal ink jet printhead, comprising:

depositing a first metal layer on a substrate having a thickness to form a power bus;

depositing a first dielectric layer;

forming a via in the first dielectric layer to connect the first metal layer to a second metal layer;

depositing the second metal layer;

depositing a resistive layer;

forming a thermal resistor in the resistive layer;

depositing a second dielectric layer; and removing a portion of the second dielectric layer using a directional etch process.

2. The method of claim 1, further comprising removing a portion of the second metal layer and depositing the resistive layer on the second metal layer and the removed portion of the second metal layer.

3. The method of claim 1, wherein removing the portion comprises etching the portion using a dry etch process.

4. The method of claim 1, wherein removing the portion using the directional etch process comprises etching the portion from an ink feed slot.

5. The method of claim 1, wherein:

the portion includes a first portion; and wherein the method further comprises removing a second portion of the second dielectric layer using a second etch process.

6. A thermal ink jet printhead, comprising:

a substrate;

a resistive layer;

a first metal layer between the substrate and the resistive layer having a thickness to form a power bus;

a second metal layer adjacent to the resistive layer to connect the thermal resistor to a control circuit;

a first dielectric layer between the first metal layer and the second metal layer, the first dielectric layer including a via to connect the first metal layer to the second metal layer;

a second dielectric layer between the second metal layer and a polymer layer, wherein the second dielectric layer is directionally removed from an ink feed slot;

a thermal resistor formed in the resistive layer; and a thermal inkjet chamber formed in the polymer layer.

7. The thermal ink jet printhead of claim 6, wherein the first and the second dielectric layers include a material selected from a group consisting of tetraethyl orthosilicate (TEOS or $Si(OC_2H_5)_4$), field oxide, silicon dioxide ($SiO_2$), undoped silicate glass (USG), phospho-silicate glass (PSG), boro-silicate glass (BSG), and boro-phospho-silicate glass (BPSG), $Al_2O_3$, $HfO_3$, SiC, SiN, and combination thereof.

8. The thermal ink jet printhead of claim 6, further comprising a passivation layer for protecting the substrate, the first metal layer, the second metal layer, the first dielectric layer, and the resistive layer.

9. The thermal ink jet printhead of claim 6, wherein a resistive material in the resistive layer is selected from a group consisting of tungsten silicide nitride (WSiN), tantalum silicide nitride (TaSiN), tantalum aluminum (TaAl), tantalum nitride ($Ta_2N$), and combination thereof.

10. The thermal ink jet printhead of claim 6, further comprising a Die Surface Optimization (DSO) layer, wherein a portion of the DSO layer is removed from the thermal resistor and an ink feed hole.

11. The thermal ink jet printhead of claim 10, wherein the portion of DSO layer removed includes an area that is at least 9 micrometers (μm) larger than a total area of the ink feed hole.

12. A method for fabricating a thermal ink jet printhead, comprising:

depositing a first dielectric layer on a substrate;

depositing a first metal layer having a thickness to form a power bus;

depositing a second dielectric layer;

forming a via in the second dielectric layer to connect the first metal layer to a second metal layer;

depositing the second metal layer to connect a thermal resistor to circuitry;

forming circuit traces and space for the thermal resistor in the second metal layer;

depositing a resistive layer;

forming the thermal resistor in the resistive layer;

depositing a third dielectric layer;

removing a first portion of the third dielectric layer using a dry etch process; and removing a second portion of the third dielectric layer using a wet etch process.

13. The method of claim 12, further comprising:

depositing a polymer layer; and forming a thermal inkjet chamber within the polymer layer.

14. The method of claim 12, wherein removing the first portion of the third dielectric layer using a dry etch process comprises removing the third dielectric layer from an ink feed slot.

15. The method of claim 12, wherein removing the second portion of the third dielectric layer using a wet etch process comprises removing the third dielectric layer from the thermal resistor in the resistive layer.

16. The method of claim 1, further comprising:

connecting the second metal layer to the thermal resistor.

17. The method of claim 1, further comprising:

forming circuit traces and space for the thermal resistor in the second metal layer.

18. The method of claim 5, wherein the second etch process includes a wet etch process.

19. The method of claim 1, further comprising:

depositing a polymer layer; and forming a thermal inkjet chamber within the polymer layer.

20. The method of claim 1, wherein removing the portion comprises removing the portion from an ink feed slot.

* * * * *